US005144721A

United States Patent [19]

Schade

[11] Patent Number: 5,144,721

[45] Date of Patent: Sep. 8, 1992

[54] ADJUSTABLE HINGE ASSEMBLY

[76] Inventor: Daniel J. Schade, 30831—13th Place S., Federal Way, Wash. 98003

[21] Appl. No.: 639,964

[22] Filed: Jan. 11, 1991

[51] Int. Cl.[5] ..... E05D 7/04; E05D 7/06

[52] U.S. Cl. ..... 16/237; 16/240; 16/DIG. 29; 16/DIG. 43; 16/387

[58] Field of Search ..... 16/236, 235, 237, 238, 16/DIG. 43, 239, 240, 248, 249, 234, 387

[56] References Cited

U.S. PATENT DOCUMENTS

| | | | |
|---|---|---|---|
| 386,186 | 7/1888 | Dahlman | 16/240 |
| 794,454 | 7/1905 | Davis et al. | 16/240 |
| 992,617 | 5/1911 | Varchmin et al. | 16/240 |
| 1,228,481 | 6/1917 | Saino | 16/237 |
| 1,229,143 | 6/1917 | Saino | 16/249 |
| 2,624,067 | 6/1953 | Tassell | 16/DIG. 29 |
| 3,183,547 | 5/1965 | Bury | 16/238 |
| 4,864,688 | 9/1989 | Gerber | 16/DIG. 29 |

*Primary Examiner*—Robert L. Spruill
*Assistant Examiner*—Donald M. Gurley
*Attorney, Agent, or Firm*—Seed and Berry

[57] ABSTRACT

An adjustable hinge assembly has a hinge and a mounting plate. The mounting plate is vertically adjustable on a cabinet wall and carries the hinge. The hinge is horizontally adjustable in and out on the mounting plate, and also has left and right horizontal adjustment on the mounting plate by way of a vertical fulcrum rib between the hinge and the mounting plate, which permits the hinge to be horizontally rocked.

4 Claims, 2 Drawing Sheets

ADJUSTABLE HINGE ASSEMBLY

TECHNICAL FIELD

The present invention relates to adjustable hinges of the type commonly used on cabinets to properly align the doors.

BACKGROUND OF THE INVENTION

Various arrangements have been provided for adjusting hinge-mounted doors relative to cabinet openings so that the doors will be level and so that the gap between meeting doors will be uniform. On relatively large doors, up-and-down and in-and-out adjustments have commonly been made by providing vertical and horizontal slots in one or the other of the hinge leaves for receiving the mounting screws. This makes accurate adjustment relatively difficult and time consuming, particularly if the door must be shifted horizontally to the right or left. In fact, if the hinge leaf on which the door is mounted is of the type having one section engaging an edge of the door and another section engaging the back of the door, left and right adjustment of the door relative to the hinge, or of the hinge relative to the cabinet wall, is virtually impossible without using shims between the mounting leaf of the hinge and the cabinet wall on which the mounting leaf is mounted.

SUMMARY OF THE INVENTION

The present invention aims to provide an improved hinge assembly which includes a mounting plate located between the mounting leaf of the hinge and the cabinet wall. This mounting plate is made vertically adjustable by providing therein vertical slots for receiving a set of mounting screws, and has horizontal slots for receiving a set of mounting bolts which pass outwardly through registering holes in the mounting leaf so that the hinge can be adjusted horizontally in and out relative to the mounting plate, and hence, relative to the cabinet. To assist this in-and-out adjustment, the mounting plate has top and bottom horizontal guide flanges which guide the upper and lower edges of the mounting leaf and lend support during adjustment.

As part of this invention a vertical fulcrum element is located between the mounting plate and the mounting leaf so that the mounting leaf can be rocked on the fulcrum element during adjustment to move the hinge right or left relative to the cabinet.

DETAILED DESCRIPTION OF THE INVENTION

Figure 1:
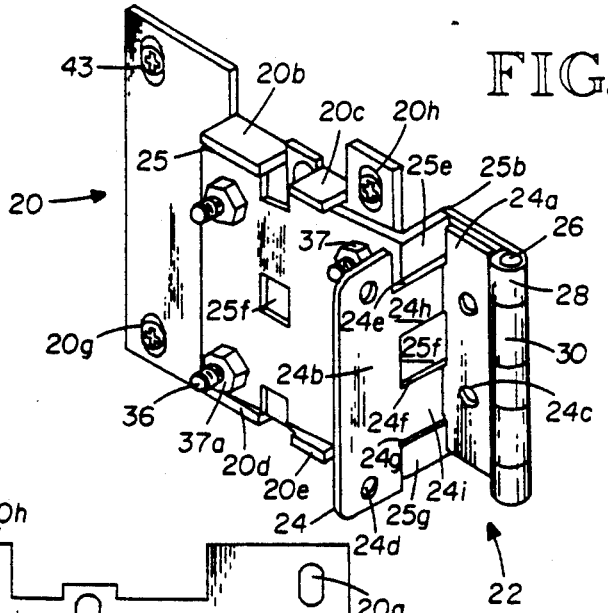
FIG. 1 is an isometric view of an adjustable hinge assembly embodying the invention.
Figure 3:
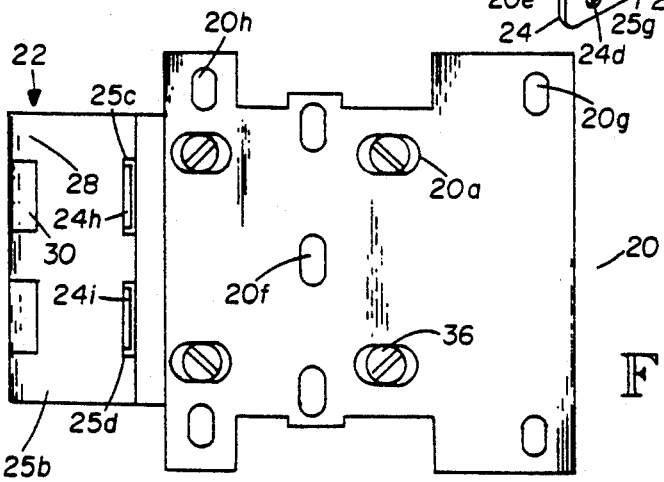
FIG. 3 is an elevational view looking from the right side of FIG. 1.
Figure 2:
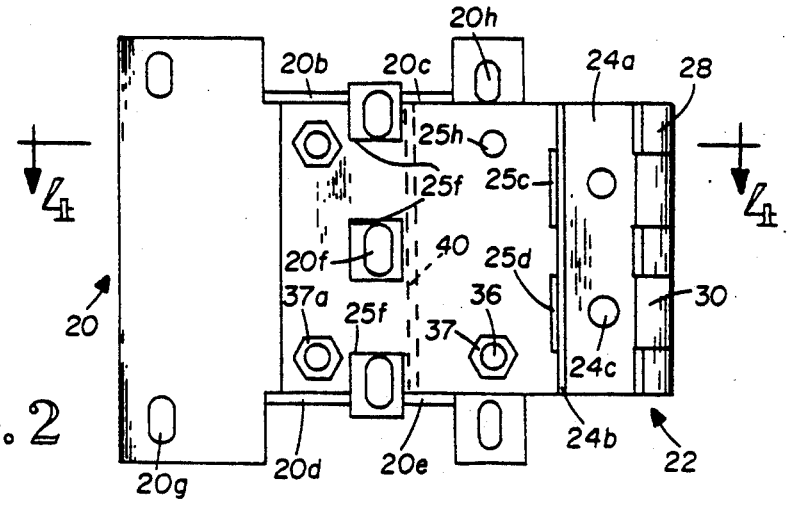
FIG. 2 is an elevational view of the hinge assembly looking from the left side of FIG. 1.

The present invention provides a novel mounting plate member 20 for use with a hinge 22 having a door-carrying leaf 24 and a support leaf member 25 which cooperates with the mounting plate member 20 to provide multiple adjustments. The hinge 22 has a pivot pin

26 defining the swing axis for the door-carrying leaf 24. This pin 26 is fixed to the support leaf member 25 by three spaced knuckles 28 on the latter, which are crimped around the pin. The knuckles 28 are complemented by two intermediate knuckles 30 on the door-carrying leaf 24 arranged to freely turn on the pin 26 for swinging the door-carrying leaf 24 relative to the support leaf member 25.

The door-carrying leaf 24 has two door-mounting sections **24*a*, 24*b* having a 90° dihedral angle therebetween, and is formed with pairs of screw holes 24*c*, 24*d*. Leaf section 24*a* adjoins the knuckles 30 and, when screw-mounted on a door 32 by screws 34 passing though the holes 24*c*, bears against a vertical edge face of the door. The leaf section 24*b* is screw-mounted against the back face of the door by screws 35 passing through the holes 24*d*** into the door.

The support leaf 25 has a mounting section **25*a* connecting to the knuckles by an offset angle section 25*b* which preferably, for use in this invention, has an included angle of about 93° rather than being a right angle as is conventional. This provides more leeway for swinging of the door-carrying leaf 24 relative to the support leaf member 25 during adjustment before the doormounting section 24*a* engages the support leaf member 25. In this regard, the angle section 25*b* has two intermediate cutouts 25*c*, 25*d* which are in staggered relationship between top, center, and bottom to cutouts 24*e*, 24*f*, 24*g* in the door-mounting section 24*b*. By this arrangement, the two portions 24*h*, 24*i* of the door-mounting section 24*b* between the three cutouts therein can occupy the two cutouts 25*c*, 25*d* in the angle section 25*b*, and the three portions 25*e*, 25*f*, 25*g* of the angle section 25*b* adjoining the two cutouts 25*c*, 25*d* therein can occupy the three cutouts 24*e*, 24*f*, 24*g* in the door-mounting section 24*a***, when the hinge is in a closed-door condition. This is standard practice and is not a contribution of this invention.

The hinge 22 is completed by four bolt holes **25*h* adjacent the corners of the mounting section 25*a*. These four holes are complemented by four horizontal adjustment slots 20*a* in the mounting plate member 20 so that the hinge 22 and, hence, the door carried by the hinge, can be adjusted horizontally in and out relative to the cabinet opening. For this purpose, the back side of the slots 20*a* is preferably tapered so that bolts 36 with chamfered heads will be flush with the back face of the mounting plate 20 when the bolts 36 project from the heads through the holes 25*h* in the mounting section 25*a* of the hinge to receive front and back pairs of nuts 37, 37*a***.

In-and-out adjustment is assisted by providing the mounting plate 20 with top and bottom sets of guide flanges **20*b*, 20*c* which oppose the top and bottom edges of the mounting section 25*a*** to hold the hinge in proper position during adjustment.

Vertical adjustment of the hinge and door 32 relative to the cabinet 38 is accomplished by vertical adjustment of the mounting plate 20 by way of three vertically spaced central slots **20*f* and back and front pairs of corner slots 20*g*, 20*h* in the mounting plate 20 for receiving anchoring screws passing into the cabinet wall 38*a*. The central slots 20*f* are preferably complemented by three vertically spaced cutouts 25*f* in the hinge-mounting section 25*a*. Preliminary vertical adjustment may be performed by use of the set of intermediate vertically extending slots 20*f* which preferably have a center spacing corresponding to that of the sets of "system" holes commonly used as a module on "European" cabinets to receive shelf-mounting pins. The front ones of these hole sets are usually set back from the front of the cabinet a standard distance, and hence can be used for prepositioning the mounting plate 20 by passing screws 42 through the intermediate slots 20***f* in the mounting plate into selected system holes for the shelf-mounting pins.

When the vertical position for the hinge 22 relative to the cabinet is established, the mounting screws 42 passing through the central vertical slot 20*f* in the mounting plate 20 may be supplemented by anchoring screws 43 passing through one or both pairs of corner slots 20*g*, 20*h*. The purpose of the three cutouts 25*f* in the hinge-mounting section 25*a* is to provide screw access to the slots 20*f* in the mounting plate 20 when the hinge 22 is connected by the bolts 36 to the mounting plate 20. In this regard, the cutouts 25*f* should have a horizontal width corresponding to the length of the horizontal slots 20*a* in the mounting plate to allow for the in-and-out adjustment of the hinge-mounting section 25*a* and the associated bolts 36.

Figure 4:
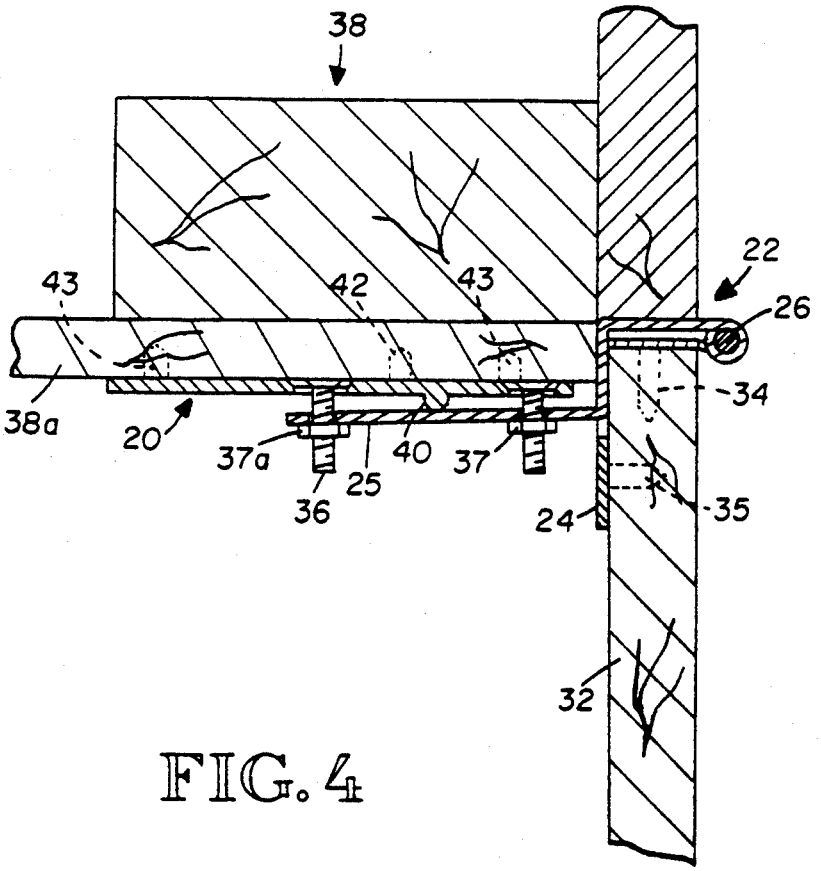
FIG. 4 is a horizontal sectional view of the hinge assembly taken as indicated by line 4—4 in FIG. 2, but with the hinge assembly mounted on a door and cabinet wall.

Directing attention to FIG. 4, a vertical fulcrum rib 40 extends from the mounting plate 20 between the three central slots 20*f* and the front two of the four slots 20*a*. This fulcrum rib 40 preferably extends for most of the vertical distance between the upper and lower flanges 20*c*, 20*e* and is engaged by the face of the mounting section 25*a* on the rib 40 by tightening or loosening the front and back pairs of nuts 37, 37*a*, which results in left-and-right movement of the door-carrying leaf 24 of the hinge in a swing arc centered at the rib 40. This results in a slight in or out movement of the axis of the hinge pin 26 and the associated door 32 relative to the mounting plate 20. If needed, this movement can be compensated for by making a slight in or out adjustment of the hinge-mounting section 25*a* relative to the mounting plate 20 by virtue of the horizontal slots 20*a* and registering bolts 36. When the desired in-and-out and right-and-left adjustment of the door is achieved, the front two nuts 37 are firmly tightened, followed by tightening of the back two nuts 37*a*.

It will be appreciated that the fulcrum rib 40 may be fixed on the back side of the hinge-mounting section 25*a* instead of on the front side of the mounting plate 20, and that the invention is applicable to hinges other than those like the cabinet door hinge 22.

I claim:

1. An adjustable hinge assembly, comprising:

a hinge having a door carrying leaf swingably mounted on a support leaf member to swing about a vertical swing axis between a closed door position and an open door position, said door carrying leaf being adapted to be vertically mounted on a door located at the front of a vertical opening adjoining a support wall which presents a vertical mounting face extending rearwardly from the right or left side of said opening;

a mounting plate member;

fastening elements passing through said mounting plate member for securing it on a said support wall to occupy a position between said support leaf member and mounting face;

a fulcrum element between said members and defining a rocking axis parallel to said swing axis whereby the support leaf member may be rocked relative to the mounting plate member to responsively adjust said closed door position in the right or left direction relative to said opening, one of said members having horizontal adjustment slots on opposite sides of said fulcrum and the others of said members having holes registering with said horizontal slots; and threaded fastening means passing through said horizontal adjustment slots and registering holes and engaging said members for rocking said support leaf member, horizontally adjusting said support leaf member, and securing said members to one another with said fulcrum element therebetween, said threaded fastening means being independent of said fastening elements.

2. An adjustable hinge assembly according to claim 1 in which said fulcrum element is fixed to one of said members.

3. An adjustable hinge assembly according to claim 1 in which said mounting plate member has exposed vertical adjustment slots receiving said fastening elements to secure the mounting plate to said support wall, whereby said support leaf member can be vertically adjusted relative to said support wall by way of vertical adjustment of said mounting plate member relative to said support wall.

4. An adjustable hinge assembly according to claim 3 in which said horizontal adjustment slots and fulcrum element are provided by said mounting plate member.

* * * * *